US011338459B2

(12) United States Patent
Palmer

(10) Patent No.: US 11,338,459 B2
(45) Date of Patent: May 24, 2022

(54) CLIPPER BLADE PROTECTOR

(71) Applicant: Derrick Palmer, Riverdale, MD (US)

(72) Inventor: Derrick Palmer, Riverdale, MD (US)

( * ) Notice: Subject to any disclaimer, the term of this patent is extended or adjusted under 35 U.S.C. 154(b) by 0 days.

(21) Appl. No.: 17/224,120

(22) Filed: Apr. 6, 2021

(65) Prior Publication Data

US 2021/0308886 A1 Oct. 7, 2021

Related U.S. Application Data

(60) Provisional application No. 63/005,675, filed on Apr. 6, 2020.

(51) Int. Cl.
*B26B 19/38* (2006.01)

(52) U.S. Cl.
CPC ..... *B26B 19/3813* (2013.01)

(58) Field of Classification Search
CPC ..... B26B 19/3813; B26B 19/38; A45D 27/22; A45D 27/00
USPC ..... 30/539–540
See application file for complete search history.

(56) References Cited

U.S. PATENT DOCUMENTS 2,320,807 A 11/1942 Upham
2,878,563 A * 3/1959 Schmoyer ..... B26B 19/38 30/539
3,277,571 A * 10/1966 Bloomfield ..... B26B 29/00 D28/47
3,290,778 A * 12/1966 Hickerson ..... B26B 29/00 D28/47
3,388,468 A * 6/1968 Hamill ..... B26B 21/40 30/540
3,396,466 A * 8/1968 Suzuki ..... B26B 29/00 30/541
3,399,455 A * 9/1968 Steere, Jr. ..... B26B 29/00 D28/47
3,530,574 A * 9/1970 Patterson ..... B26B 21/40 30/540
4,251,915 A * 2/1981 Ullmann ..... B26B 19/3866 30/43.92
4,751,781 A 6/1988 Szymansky et al.
4,984,366 A * 1/1991 Powers ..... A45D 29/023 30/28
5,348,152 A 9/1994 Kiyoshi et al.
5,975,290 A 11/1999 Lowe
D435,936 S 1/2001 Long et al.
6,901,669 B1 6/2005 Liberatore
(Continued)

FOREIGN PATENT DOCUMENTS

CN 103648734 B 3/2014
WO WO-2013015034 A1 * 1/2013 ..... A45D 27/29

*Primary Examiner* — Nhat Chieu Q Do

(57) ABSTRACT

A clipper blade protector enabling a user to enclose and protect the blades and teeth of clipper devices by incorporating a sheath body, a volume of cushion material, and a blade-receiving concavity. The sheath body extends between a cover end and an opening, wherein the blade-receiving cavity is formed within the sheath body between the opening and the cover end. The volume of cushion material is externally distributed along the sheath body between the cover end and the opening, thereby cushioning any external impacts against the enclosed portion of the clipper device. This protection is proposed to prevent breakage of the blades and teeth of the clipper device, saving both time and money in avoided replacements costs and maintenance.

8 Claims, 7 Drawing Sheets

(56) References Cited

U.S. PATENT DOCUMENTS

| | | | | |
|---|---|---|---|---|
| 7,356,934 | B2 | 4/2008 | McCambridge et al. | |
| 7,882,872 | B2 | 2/2011 | Frierson | |
| D711,595 | S | 8/2014 | Walker | |
| 2006/0156551 | A1* | 7/2006 | Khubani | B26B 19/3813 30/130 |
| 2016/0015147 | A1* | 1/2016 | Lampard | A45D 27/22 206/208 |
| 2019/0374002 | A1* | 12/2019 | Capell | A45D 27/48 |

* cited by examiner

CLIPPER BLADE PROTECTOR

The current application claims a priority to the U.S. Provisional Patent application Ser. No. 63/005,675 filed on Apr. 6, 2020.

FIELD OF THE INVENTION

The present invention relates generally to a protective sleeve or cover for a barber tool. More specifically, the present invention provides a form-fitting sleeve that would prevent damage to a clipper blade and teeth during storage and transit. The present invention is further provided with a measure of impact resistance, thereby preventing damage to the blades from dropping the tool.

BACKGROUND OF THE INVENTION

The biggest risk of damage to clipper blades and teeth most frequently occurs during transit or storage. A common makeshift attempt by barbers to address this problem has historically been to cover the clipper blades with a cloth sock. However, a cloth sock critically lacks the functionality to effectively protect the clippers from damage. The present invention intends to serve as a functional, yet cost-effective solution to fulfill the need for means of protecting clipper blades from damage during storage or transit.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

The present invention comprises a sheath body 10, a volume of cushion material 11, and a blade-receiving cavity 12. The sheath body 10 defines a protective enclosure of variable dimensions and material specification. The preferred embodiment is suitable for extended exposure to hazards typically associated with operating a barber shop or cosmetology studio, e.g., heat, abrasion, sterilant, dyes, or other compounds commonly found in these settings. The volume of cushion material 11 constitutes a likewise-durable material configured to be compressible or otherwise physically resilient to impacts, such that the volume of cushion may protect a clipper device stored within the sheath body 10. Accordingly, the blade-receiving cavity 12 defines a void, pocket, or other substantially empty space within the sheath body 10 configurable to receive said clipper device.

Figure 1:
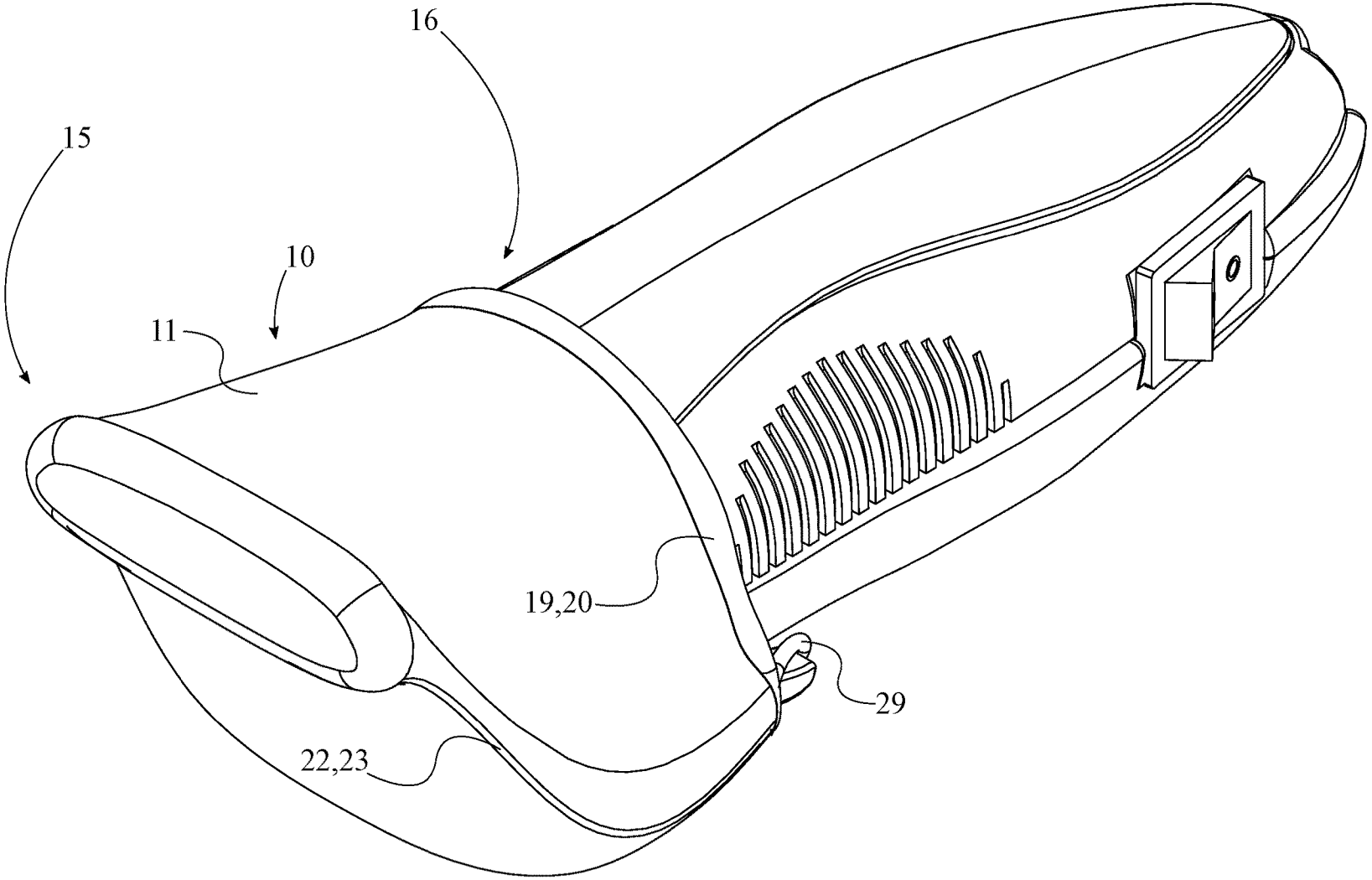
FIG. 1 is a top-front-left perspective view of the present invention, wherein the present invention is shown mounted to an exemplary clipper device.
Figure 3:
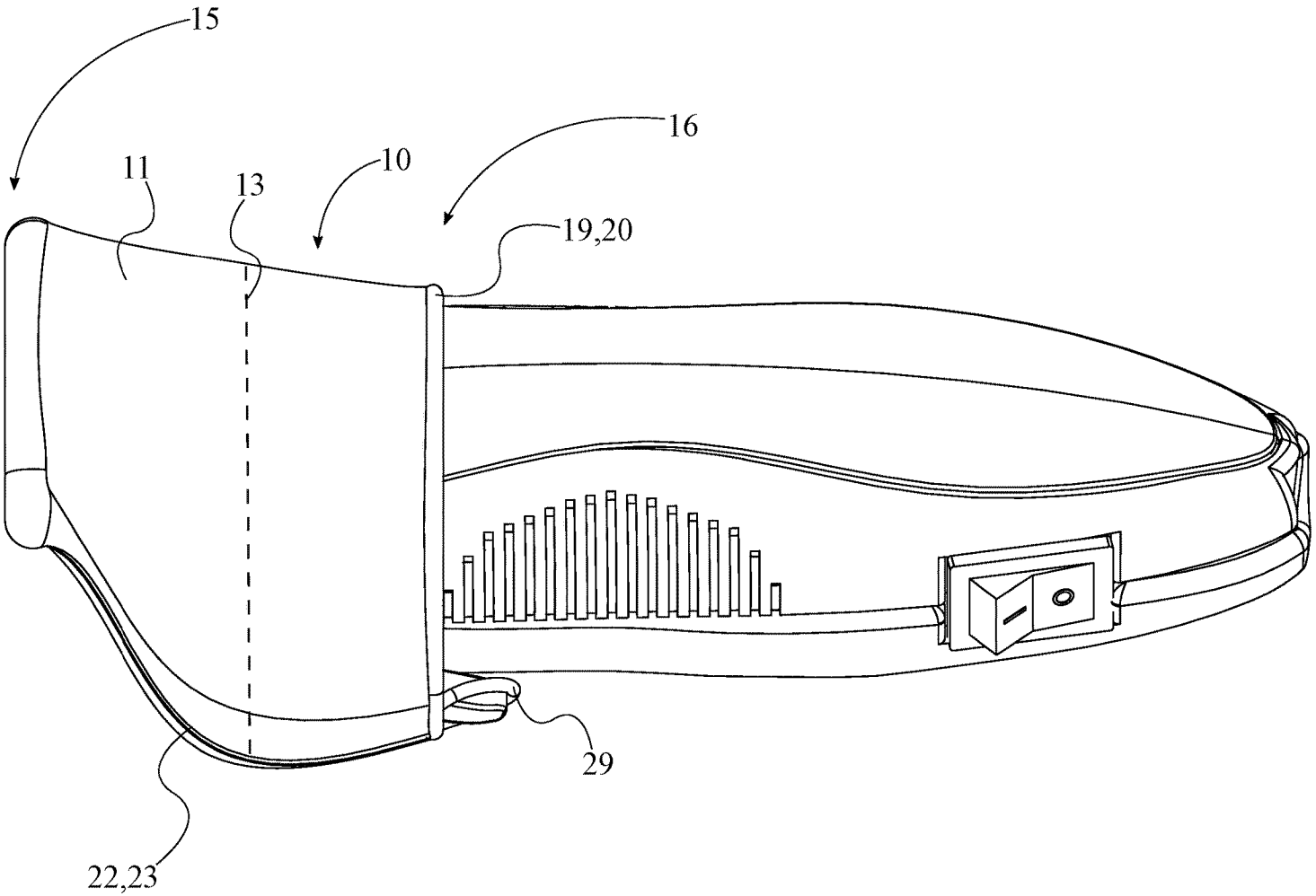
FIG. 3 is a top-left perspective view of the present invention.

In a preferred embodiment shown in FIGS. 1 and 3, the sheath body 10 extends between a cover end 15 and an opening 16 with the blade-receiving cavity 12 being formed within the sheath body 10 between the opening 16 and the cover end 15. In this embodiment, the sheath body 10 does not substantially enclose the clipper device whole. Instead, only a clipper head and any other fragile structures positioned at the effector-end of the clipper device are enclosed within the blade-receiving concavity. This arrangement minimizes the material bulk of the present invention while maximizing the protective value of the sheath body 10 to the components most-likely to experience breakage during transport or mishandling. It is proposed that the sheath body 10 may measure approximately three to four inches in length, at one inch in height, with one inch in depth to accommodate most common varieties of clipper device. However, these dimensions may be variable between embodiments and are not to be construed as limiting the scope of the invention. Further, rubber, polyethylene foam, and polystyrene are all considered as preferred composite materials for the present invention, whereby the present invention may be formed by an injection-molding process. This material contemplation, including the method of manufacture, are likewise not to be construed as limiting.

Figure 6:
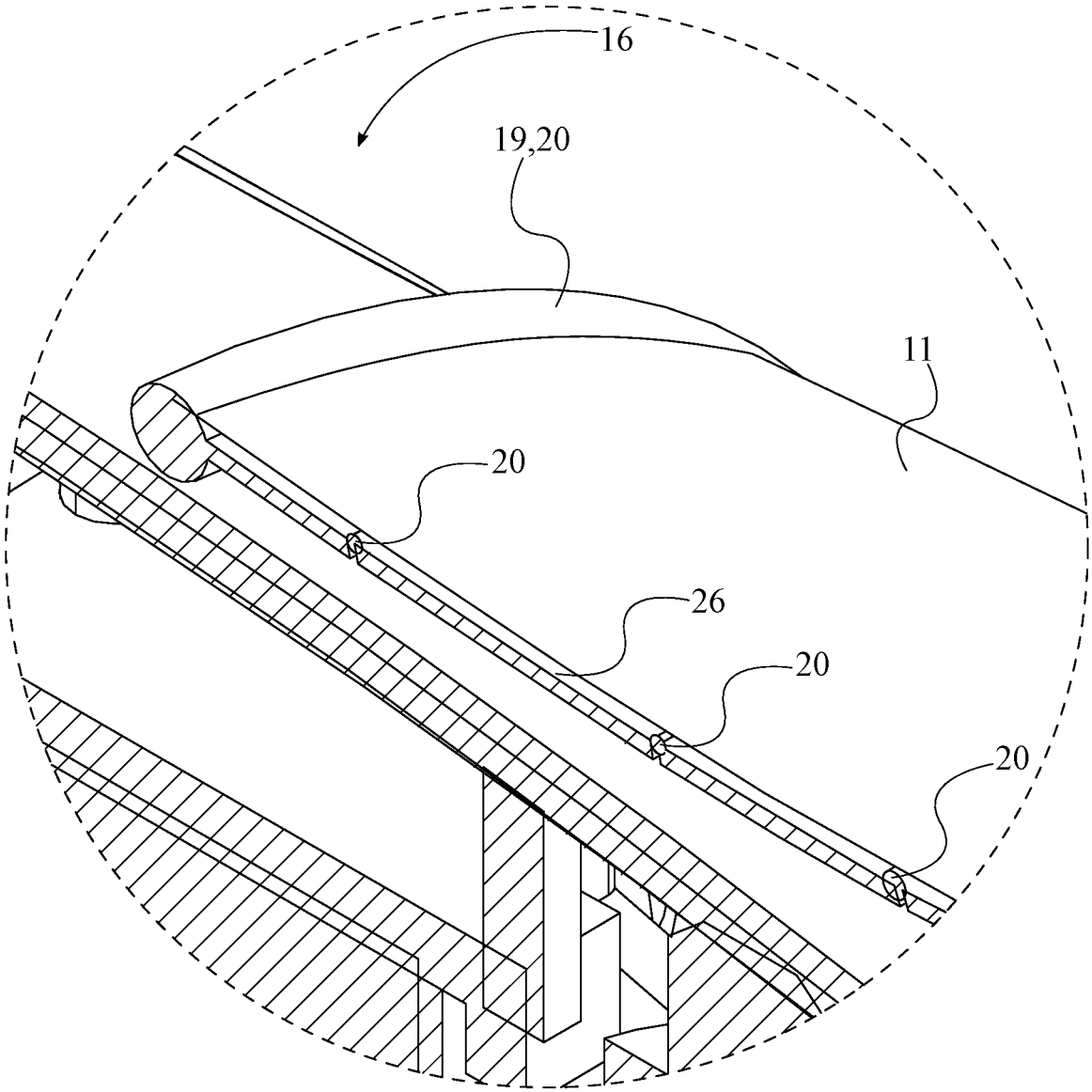
FIG. 6 is a detail view of area 6 of FIG. 5.
Figure 7:
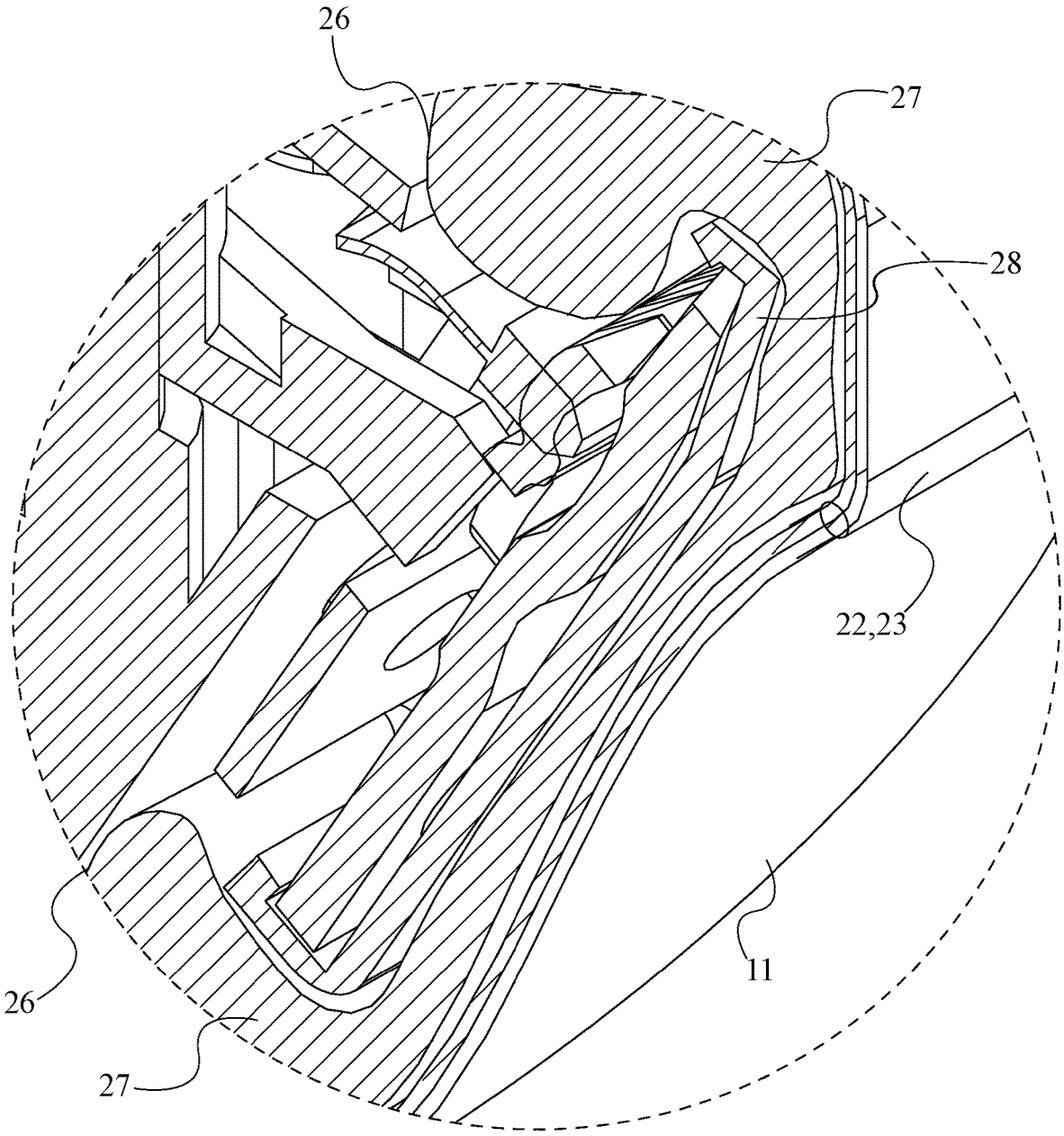
FIG. 7 is a detail view of area 7 of FIG. 5.

To further improve the protective qualities of the present invention, the volume of cushion material 11 is externally distributed along the sheath body 10 between the cover end 15 and the opening 16 as shown in FIGS. 6 and 7. The arrangement of the sheath body 10 within the volume of cushion material 11 ideally presents the durable, sacrificial layer of the present invention towards any external threats while maintaining the sheath body 10 in position on the clipper device. Accordingly, any damage that may otherwise cause breakage of the clipper blades or teeth is absorbed by the volume of cushion material 11 without dislodging the clipper device from within the blade-receiving concavity.

It is considered further that, in at least one embodiment, the sheath body 10 and the volume of cushion material 11 may be formed of a single, contiguous material. In this embodiment, the structural and protective qualities described above are provided as emergent features of a variable-density textile, i.e., denser towards the blade-receiving cavity 12 and less dense externally.

Figure 2:
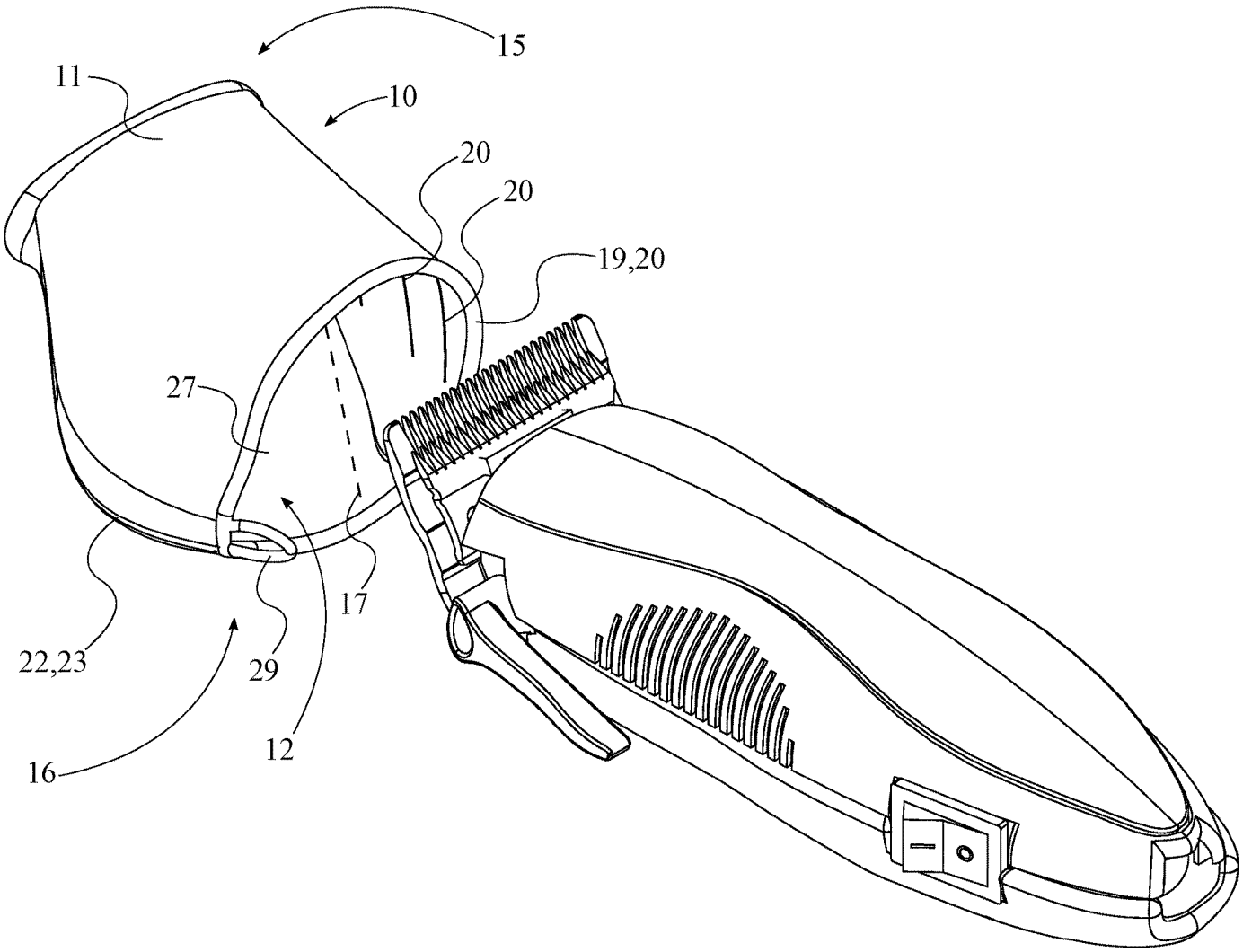
FIG. 2 is a top-rear-left perspective view thereof, wherein the present invention is shown detached from the exemplary clipper device.

It is understood that a plethora of manufacturers and models exist for various clipper devices and clipper heads, thereby necessitating a universal mounting system to enable use of the present invention with any of these variant models. As shown in FIGS. 1, 2, and 6, the present invention further comprises at least one elastic element 19. The at least one elastic element 19 ideally defines a band of flexible, adaptable material suitable for fixing the present invention to a variety of clipper devices by substantially encircling and constricting to the clipper device. More specifically, the at least one elastic element 19 is mounted to the sheath body 10 around the opening 16, wherein the elastic element is configured to control a diameter 17 of the opening 16. The diameter 17 of the opening 16 is broadly suggested to be as variable as necessary to accommodate any type or variety of clipper device, clipper head, or variant thereof as may be realized by a reasonably skilled individual.

As illustrated in FIG. 6, the at least one elastic element 19 further comprises a plurality of elastic elements 20. The plurality of elastic elements 20 is mounted to the sheath body 10 between the opening 16 and the cover end 15, wherein the plurality of elastic elements 20 is configured to control at least one lateral dimension 13 of the blade-receiving cavity 12. This expanded alternate embodiment enables the present invention to assume a form-fitting profile about a clipper device, thereby limiting the opportunity for the clipper head to become unintentionally dislodged from within the blade-receiving cavity 12. Further, the introduction of the plurality of elastic elements 20 allows the sheath body 10 to plastically deform to accommodate irregular protuberances on the clipper device, such as the operating lever shown in FIG. 2 through 4.

Integration of the plurality of elastic elements 20 into the sheath body 10 may additionally produce an embodiment of the present invention wherein the sheath body 10 is itself substantially elastic. More specifically, the inclusion of the plurality of elastic elements 20 as a substantive percentage of the composite material of the sheath body 10 may enable the sheath body 10 to deform across multiple axes. Accordingly, the structure of the plurality of elastic elements 20 and the sheath body 10 may also be similar to other hybrid textiles or mixed fabrics as may be realized by an individual of ordinary skill.

In addition to the flexibility and elasticity provides by the above-described elements, it is proposed that the sheath body 10 must retain some structural rigidity. This configuration enables a user to easily equip and dismount the present invention to a clipper device without collapsing the overall shape of the sheath body 10 and, by extension, the blade-receiving cavity 12. Accordingly, the present invention may comprise at least one elongate support member 22 as shown in FIGS. 1 and 2. The at least one elongate support member 22 is externally integrated to the sheath body 10 between the opening 16 and the cover end 15, thereby ensuring that the sheath body 10 does not fold in upon itself as the clipper device is removed from the blade-receiving cavity 12.

Figure 4:
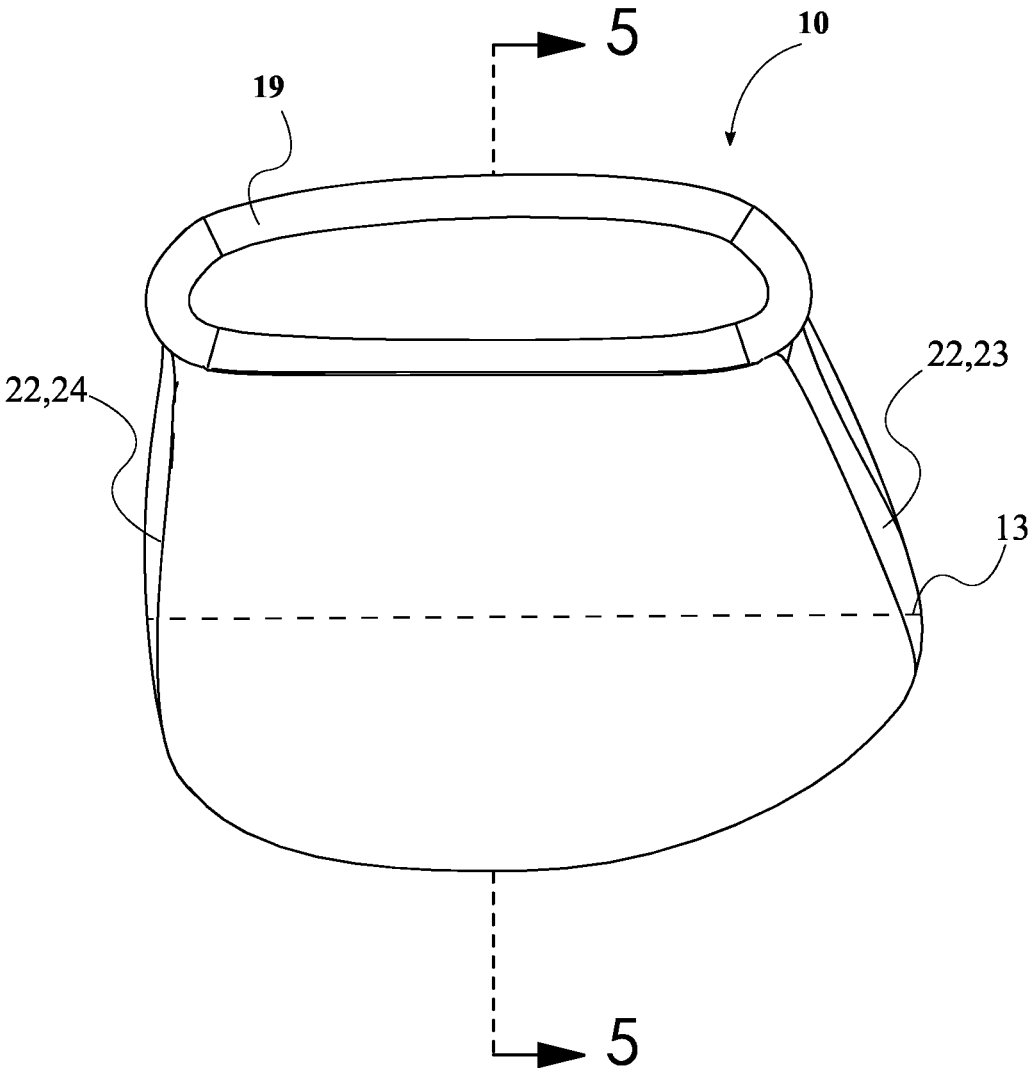
FIG. 4 is a front elevational view of the present invention, wherein the deformation of the present invention to accommodate the exemplary clipper device is shown.
Figure 5:
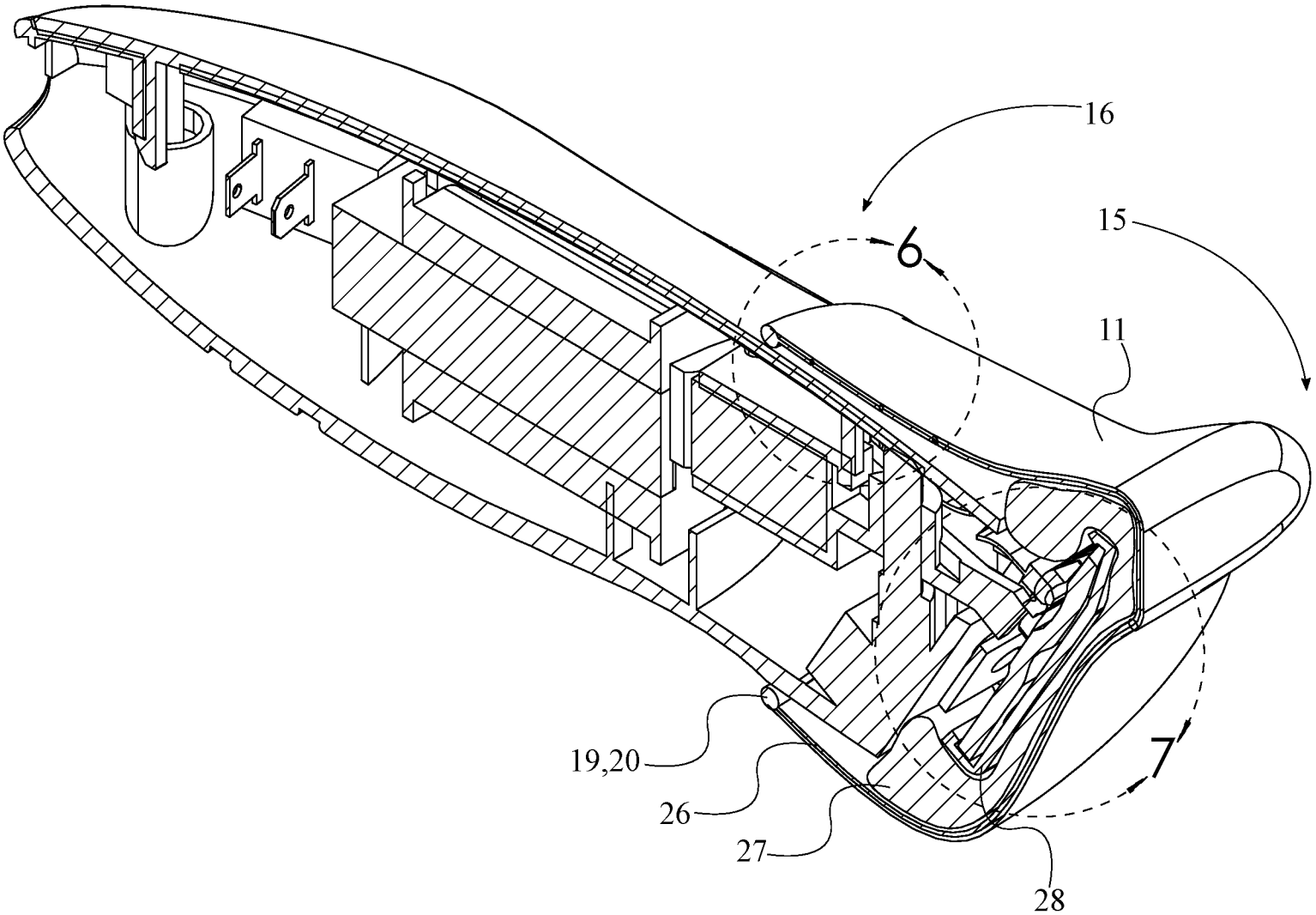
FIG. 5 is a sectional view taken along line 5-5 in FIG. 4.

In another embodiment, the at least one elongate support member 22 comprises a first support member 23 and a second support member 24. The first support member 23 and the second support member 24 are radially distributed about the sheath body 10 and are coterminous adjacent to the cover end 15. As shown in FIG. 4, this arrangement forms a 'halo' across the cover end 15 of the body sheath, thereby preventing extreme deflections of the sheath body 10 while mounting and dismounting to a clipper device. However, the arrangement of the first support member 23 and a second support member 24 at a radial dispersion will still enable the sheath body 10 to be compressed flat for storage whilst not in use.

The present invention is primarily directed towards the enclosure and protection of a bladed or toothed instrument from external damage, but it is realized that the clipper blade and teeth may damage the sheath body 10 internally after prolonged use. Accordingly, the present invention is provided with at least one cut-resistant layer 26 as shown in FIGS. 6 and 7. In the preferred embodiment, the at least one cut-resistant layer 26 defines an impermeable textile or strand configured to prevent the sharpened edges of the clipper blade and teeth from abrading, puncturing, or snagging into the material of the sheath body 10. Accordingly, the at least one cut-resistant layer 26 is integrated to the sheath body 10 between the opening 16 and the cover end 15, opposite the volume of cushion material 11 across the sheath body 10. To maintain the flexible format of the sheath body 10, it is contemplated that the at least one cut-resistant layer 26 constitutes a normalizing or plasticizing surface treatment of the composite material of sheath body 10 within the blade-receiving cavity 12. The at least one cut-resistant layer 26 may also be limited to specific 'high-wear' areas without departing from the original spirit and scope of the invention.

To protect particularly fragile components, or to avoid transferring any drop-induced damage into the operating mechanism of the clipper device, the present invention may further comprise a shock-absorbent layer 27. As shown in FIG. 7, the shock-absorbent layer 27 is mounted between the at least one cut-resistant layer 26 and the sheath body 10, opposite the volume of cushion material 11 across the sheath body 10. In the preferred embodiment of the present invention, the shock-absorbent layer 27 is flexibly positioned about the clipper head to prevent the clipper blade from being forced back into the operating mechanism of the clipper device, thereby preventing damage to said operating mechanism.

Further, the present invention may comprise at least one blade bracket 28 to mechanically engage a clipper head within the blade-receiving cavity 12 as shown in FIG. 7. This engagement further ensures that the clipper blade remains protected within the blade-receiving cavity 12 during transportation. To facilitate this attachment, the at least one blade bracket 28 is mounted to the sheath body 10 within the blade-receiving cavity 12 adjacent to the cover end 15, wherein the blade bracket is configured to receive the clipper head of a clipper device.

The fixture of the clipper head into the blade-receiving cavity 12 may be further supplemented with at least one sheath fastener 29. The at least one sheath fastener 29 provides a means for the sheath body 10 to be fixed to some protruding element of the clipper device, such as the operating lever as shown in FIG. 3. In the broadest conception, the at least one sheath fastener 29 is mounted to the sheath body 10 adjacent to the opening 16, wherein the sheath fastener is configured to receive a protruding member of the clipper device. The protruding member may refer to the operating lever as shown, or may refer to any other user controls, gripping feature, power cable, or any other suitable irregularity in the shape of the clipper device. Further, a user may hang the present invention by the at least one sheath fastener 29 whilst the present invention is not in use, enabling multiple iterations of the present invention to be conveniently stowed together.

Although the invention has been explained in relation to its preferred embodiment, it is to be understood that many other possible modifications and variations can be made without departing from the spirit and scope of the invention as hereinafter claimed.

What is claimed is:

1. A clipper blade protector comprising:

a sheath body;

a volume of cushion material;

a blade-receiving cavity;

the sheath body extending between a cover end and an opening;

the blade-receiving cavity being formed within the sheath body between the opening and the cover end;

the volume of cushion material being externally distributed along the sheath body between the cover end and the opening;

at least one elastic element, wherein the at least one elastic element is mounted to the sheath body around the opening, wherein the elastic element is configured to control a diameter of the opening;

at least one blade bracket, wherein the at least one blade bracket is mounted to the sheath body within the blade-receiving cavity adjacent to the cover end and wherein the blade bracket is configured to receive a clipper head of a clipper device; and at least one sheath fastener, wherein the at least one sheath fastener is mounted to the sheath body adjacent to the opening and wherein the sheath fastener is configured to receive a protruding member of the clipper device.

2. The clipper blade protector as claimed in claim 1 comprising:

the at least one elastic element comprising a plurality of elastic elements; and the plurality of elastic elements being mounted to the sheath body between the opening and the cover end, wherein the plurality of elastic elements is configured to control at least one lateral dimension of the blade-receiving cavity.

3. The clipper blade protector as claimed in claim 1 comprising:

at least one elongate support member; and the at least one elongate support member being externally integrated to the sheath body between the opening and the cover end.

4. The clipper blade protector as claimed in claim 3 comprising:

the at least one elongate support member comprising a first support member and a second support member; and the first support member and the second support member being radially distributed about the sheath body and coterminous adjacent to the cover end.

5. The clipper blade protector as claimed in claim 1 comprising:

at least one cut-resistant layer; and the at least one cut-resistant layer being integrated to the sheath body between the opening and the cover end, opposite the volume of cushion material across the sheath body.

6. The clipper blade protector as claimed in claim 5 comprising:

a shock-absorbent layer; and the shock-absorbent layer being mounted between the at least one cut-resistant layer and the sheath body, opposite the volume of cushion material across the sheath body.

7. The clipper blade protector comprising:

a sheath body;

a volume of cushion material;

a blade-receiving cavity;

the sheath body extending between a cover end and an opening;

the blade-receiving cavity being formed within the sheath body between the opening and the cover end;

the volume of cushion material being externally distributed along the sheath body between the cover end and the opening;

at least one elastic element;

the at least one elastic element being mounted to the sheath body around the opening, wherein the elastic element is configured to control a diameter of the opening;

the at least one elastic element comprising a plurality of elastic elements;

the plurality of elastic elements being mounted to the sheath body between the opening and the cover end, wherein the plurality of elastic elements is configured to control at least one lateral dimension of the blade-receiving cavity;

at least one elongate support member;

the at least one elongate support member being externally integrated to the sheath body between the opening and the cover end;

the at least one elongate support member comprising a first support member and a second support member;

the first support member and the second support member being radially distributed about the sheath body and coterminous adjacent to the cover end;

at least one blade bracket, wherein the at least one blade bracket is mounted to the sheath body within the blade-received cavity adjacent to the cover end and wherein the blade bracket is configured to receive a clipper head of a clipper device; and at least one sheath fastener, wherein the at least one sheath fastener is mounted to the sheath body adjacent to the opening and wherein the sheath fastener is configured to receive a protruding member of the clipper device.

8. The clipper blade protector as claimed in claim 7 comprising:

at least one cut-resistant layer;

the at least one cut-resistant layer being integrated to the sheath body between the opening and the cover end, opposite the volume of cushion material across the sheath body;

a shock-absorbent layer; and the shock-absorbent layer being mounted between the at least one cut-resistant layer and the sheath body, opposite the volume of cushion material across the sheath body.

* * * * *